United States Patent [19]

Zapp et al.

[11] 3,990,598

[45] Nov. 9, 1976

[54] DISPENSING CLOSURE

[75] Inventors: Walter Zapp, Oberegg; Werner Dubach, Effretikon, both of Switzerland

[73] Assignee: REFIL Aktiengesellschaft

[22] Filed: Dec. 15, 1975

[21] Appl. No.: 641,078

[30] Foreign Application Priority Data

Oct. 31, 1975 Switzerland ..... 14086/75

[52] U.S. Cl. ..... 215/272; 215/320; 215/305; 215/306; 215/237; 215/344

[51] Int. Cl.[2] ..... B65D 45/32

[58] Field of Search ..... 215/272, 320, 321, 235, 215/236, 237, 244, 256, 305, 306, 100.5, 245

[56] References Cited

UNITED STATES PATENTS

| | | | |
|---|---|---|---|
| 2,814,404 | 11/1957 | Towns | 215/320 |
| 2,894,654 | 7/1959 | Lohrer | 215/235 |
| 2,990,077 | 6/1961 | Van Baarn | 215/256 |
| 3,851,783 | 12/1974 | Braginetz | 215/245 |

*Primary Examiner*—Ro E. Hart
*Attorney, Agent, or Firm*—Gilbert L. Wells; Heinrich W. Herzfeld

[57] ABSTRACT

This invention relates to a closure which serves hermetically to close — though being easily reopened — a bottle or similar container, which possesses a neck having a dispensing orifice, a neck frontal face surrounding said orifice and an orifice bead located below the latter and having a constriction on its underside, and which closure comprises a cap serving as the head of the closure, with an upper cap wall ( or roof wall of the cap ) and a cap side wall circumferential about the latter and possessing slot means, extending from its lower rim and transversely to the latter, to permit it to splay ( or spread ) on being mounted on the mouth of the bottle, and with an inner annular bead, projecting inwards from the inner face of the cap side wall and intended, in the closing position, to engage with the underside of the orifice bead of the bottle, a sealing element, provided on the inner face of the upper cap wall and serving, in the closing position, to seal the dispensing orifice of the bottle, a lifting element which may be actuated by the finger and is located on the actuating side of the cap, and a fixing device which, in the closing position, annularly bridges each slot present in the cap side wall, by sealingly pressing the inner annular bead of the cap side wall against the constricted underside of the orifice bead of the bottle, and which is linked to the cap side wall in at least one region, remote from the actuating side of the cap side wall; the fixing device comprises at least one tensioning member which, in the closing position, is tensioned by being stretched tangentially to the cap side wall and as a result effects a compression of each slot present in the side wall and provides a uniform pressure, from all sides, of the inner annular bead of the cap against the underside of the bottle neck.

31 Claims, 17 Drawing Figures

DISPENSING CLOSURE

This invention relates to a closure which serves hermetically to close — though being easily reopened — a bottle or similar container, which possesses a neck having a dispensing orifice, a neck frontal face surrounding said orifice and an orifice bead located below the latter and having a constriction on its underside, and which closure comprises a cap serving as the head of the closure, with an upper cap wall (or roof wall of the cap) and a cap side wall circumferential about the latter and possessing slot means, extending from its lower rim and transversely to the latter, to permit it to splay (or spread) on being mounted on the mouth of the bottle, and with an inner annular bead, projecting inwards from the inner face of the cap side wall and intended, in the closing position, to engage with the underside of the orifice bead of the bottle, a sealing element, provided on the inner face of the upper cap wall and serving, in the closing position, to seal the dispensing orifice of the bottle, a lifting element which may be actuated by the finger and is located on the actuating side of the cap, and a fixing device which, in the closing position, annularly bridges each slot present in the cap side wall, by sealingly pressing the inner annular bead of the cap side wall against the constricted underside of the orifice bead of the bottle, and which is linked to the cap side wall in at least one region, remote from the actuating side, of the cap side wall.

A closure of this type is already known from U.S. Pat. No. 2,671,572 to William Satz, granted on 9th Mar. 1954. The bottle closures described in German Offenlegungsschriften Nos. 2,210,414 to Albert Obrist & Co. and 2,319,617 to Jean Grussen provide ring members which are connected in a manner which permits swivelling to a cap and are connected to the periphery of the cap by small tear-off stays prior to the first opening of the bottle, with the undamaged stays merely indicating that the cap has never yet been removed from the filled bottle. After tearing the stays, the ring member serves as a gripping ring for the first opening of the bottle, and for removing the cap whenever subsequently the bottle is opened. However, neither of the two last-mentioned ring members contributes to a better fixing of the cap onto the bottle mouth to resist internal pressure in the bottle. The bottle closure described in U.S. Pat. No. 3,825,144 by Walter Wiedmer is either blown off the bottle if the pressure therein rises, even by a relatively small amount, or is too stiff and therefore is seated too firmly to permit easy opening of the bottle with one finger of one hand.

In contrast to these ring members, the ring member provided in the closure of William Satz, and described above, plays an essential role in sealing the closing of the bottle, but this ring member suffers from certain disadvantages. In order that it shall sufficiently sealingly press the slotted cap side wall against the orifice bead of the bottle, the ring must not be excessively elastic. Furthermore, on the lifting side there is, over a zone corresponding to an approximately 40° arc of a circle, no contact between the ring member and the cap side wall. In order that the cap side wall should evenly press against the bottle over the remaining circumference of about 320°, the ring member must be relatively rigid and therefore its action on the cap side wall is more to hold it together than to compress it, that is to say the lower end regions of the tabs are passively prevented from being splayed off the underside of the orifice bead of the bottle if the pressure inside the bottle should rise, e.g. as a result of a rise in temperature or of shaking the contents, but are not actively pressed against the underside of the orifice bead. If the latter is to be achieved, the pressure of the ring member on the cap side wall must be so great that lifting the ring member in order to open the bottle becomes much more difficult.

However, it is a well-known problem of such bottle closures that on the one hand they are to achieve the most effective seal of the dispensing orifice of the bottle, which seal withstands even increased internal pressures of 6 to 8 atmospheres gauge, whilst on the other hand the opening of the bottle by removing the closure should be so easy that it should not require any tools and should if possible be achievable with one finger, e.g. the thumb of the hand which holds the bottle by the neck.

It is therefore a principal object of the invention to provide a closure of the type described initially in which the ring member actively and sufficiently seals the bottle whilst acting on the cap side wall on all sides of the bottle neck and nevertheless permits the removal of the ring member and lifting of the cap with relatively little exertion of force, e.g. with the thumb of the hand which holds the bottle by the neck.

It is a further object of the present invention that the sealing of the dispensing orifice of the bottle in the closing position, which in the closure described initially is to be effected by a sealing disc of flexible material inserted into the inside of the cap, should be adaptable to the unevennesses which are usually found, above all in bottles made of glass, both on the frontal face and on the inner wall of the part surrounding the dispensing orifice, in the form of variations of up to 1 mm in height or width, and to ensure a seal regardless of these unevennesses.

These objects and purposes are attained and further advantages described below are achieved by a closure of the initially described type which, in accordance with the present invention, is improved in that the fixing device comprises at least one tensioning member which, in the closing position, is tensioned by being stretched tangentially to the cap side wall and as a result effects a compression of each slot present in the side wall and provides a uniform pressure, from all sides, of the inner annular bead of the cap against the underside of the orifice bead of the bottle neck.

According to a preferred embodiment the cap possesses, in its side wall, a single slot, located on the actuating side, or two slots, at some distance from the actuating side, and the ring member may possess a recess, running transversely to the plane of the ring, on its inner wall opposite each slot, whilst the tensioning device comprises, on either side of each slot, ramp portions which project from the outer face of the side wall of the cap, the said ramp portions projecting, in the vicinity of the lower peripheral rim of the cap, by so much that the bottom surface of the recess of the ring member, when the latter is moved downwards into the closing position, runs onto the ramps and tensions the ring member in the direction away from the central axis of the cap.

The ramps can in that case be broadened out in the direction of the lower peripheral rim of the cap so that the side walls of the recess in the ring member, when the latter is moved downwards into the closing position, run onto the ramps so as to compress them and narrow the slot between them. The recess can preferably have dovetail-shaped cross-section.

Furthermore, the ramps may each possess, in an intermediate region between the upper face and the lower peripheral rim of the closure device constructed as a cap, a hump over which the bottom surface of the recess of the ring member must be forced when it is pushed into the closing position. The recess in the ring member can advantageously be so contructed that even when the ring member is completely swung downwards until it rests against the bottle neck the side walls of the recess remain in contact with the outer faces of the ramps and compress the recess so as to narrow the slot.

On the other hand, the ramps may possess, at their lower ends, stop noses which prevent downward movement of the recess of the ring member beyond the lower rim of the ramps.

The cap may also possess a stop above the ramps, against which stop the ring member strikes when raised, thereby lifting the cap from the neck of the bottle.

Preferably, in the state of the closure before it is mounted on the bottle, thre is a sufficient air gap, on the one hand, between the ramps and the adjacent regions of the cap side wall which extend away from the actuating side towards the opposite side, and, on the other hand, between the bottom surface and the side walls of the recess and the regions of the ring member which adjoin either side of the recess, in the plane of the ring, so that it is possible to manufacture the closure integral with the ring member on the actuating side slightly above the zone in which the ring member runs onto the ramps.

Preferably, the ring member is constructed as an arc and is hinged to either side of the cap at positions of the cap side wall which are displaced from the non-actuating side towards the actuating side. The ring member constructed as an arc may enclose an angle of arc of 100° to 330°, and preferably of 120° to 180°, about the actuating side, between the positions at which it is hinged to the cap.

It is particularly advantageous if the cap possesses, on the inner wall of its top face, a stopper part which, in the closing position, projects into the mouth of the bottle to act as a guide and seal and, optionally, a sealing collar which projects inwardly from the cap inner wall is provided as a sealing member around the stopper part, the said sealing collar being elastically deformed, in the closing position, so that it rests sealingly on the frontal face of the bottle mouth. At the same time, a free passage may at all times remain, between the stopper part and the free rim of the collar, to connect the inner space between the collar and the cap inner wall with the space in the bottle neck below the stopper part.

To prevent the closure from dropping off when it is opened with the thumb of the hand which holds the bottle, it suffices, in general, for the index finger of the same hand to rest lightly on the top face of the cap near the hinge side. On the other hand, it is here again possible for the closure device to comprise a part of the actuating device such as a supporting member which is firmly mountable on the bottle neck below the bottle mouth, the cap being carried, in a manner which permits swivelling, on the said part, on the hinge side. In order conjointly to carry the securing ring and the cap in a manner which permits swivelling, an elastically flexible strap joint may be provided on the collar, said joint preferably being integral with the collar and the securing ring.

A particularly good sealing effect, with good removability of the closure, is achieved if, in the preferred embodiment described above, the closure device, constructed as a cap, bears on the inner wall of its upper face, as a sealing element, a stopper whereof, in the closing position, the lower end projects into the bottle mouth, whilst its cylindrical outer wall is chamfered towards the lower end, the chamfer being such that it projects out of the mouth of the bottle to beyond the frontal face of the bottle neck and, in the closing position, is pressed tangentially against the curved rim of the mouth of the bottle, as a result of which the pressure of the inner bead of the cap side wall against the underside of the orifice bead of the bottle is intensified and the regions in which the ramps run up against the bottom surface of the recess of the ring member are angled slightly.

At the same time, it is particularly advantageous that the annular space in the interior of the closure device around the stopper is constantly in communication with the external air via the upper end of the slot.

The combination of the stopper with a chamfered lower outer end face, which is at a distance from the inner face of the upper wall of the cap which is smaller than the distance of the inner bead, present on the inner wall of the lateral surface of the cap, from the inner face of the cap upper wall, permits particularly advantageous interaction of forces in that the chamfered surface of the stopper rests against the annular zone at the transition from the frontal face of the mouth to the inner wall of the bottle neck takes place approximately diametrically opposite the zone where the inner bead rests against the constricted underside of the orifice bead of the bottle neck, with the pressure, especially of the inner bead against the underside of the orifice bead of the bottle, being intensified by the tensioning action (toggle action) of the bottom surface and lateral faces of the recess on the inside of the ring member against the contact faces of the ramps, on either side of the slot in the cap, in the closing position of the ring member.

Here again, the stopper can be sealed from the inside of the bottle by a cross-wall located below the chamfer, whilst the space surrounded by the stopper may be open towards the top.

The stopper can furthermore, to achieve a labyrinth-like seal, carry a plurality of annular ribs circumferential about the said stopper, the height of the annular ribs being preferably from 0.01 to 0.2 mm and especially from 0.05 to 1 mm.

According to an embodiment which is of particularly simple design and is easy to manufacture, the slotting of the cap side wall can consist of at least two slots which are uniformly distributed over the regions between the actuating side and the opposite side of the cap side wall, and one tensioning member per slot can be provided, which bridges said slot, is in the form of an arc, is elastically extensible when the slot is splayed, and is hinged to the cap side wall on either side of the slot which it bridges and at a short distance therefrom, whilst the lifting member provided on the actuating side is rigidly connected to the cap side wall and can preferably be constructed integral therewith.

Preferably, two slots can be provided of which each is staggered, from the centre of the actuating side of the cap, for example through an angle of about 60°, towards the opposite side of the cap side wall.

The cap side wall can have a non-circular cross-section, with the region of the inner annular bead of the cap located on the actuating side being at a shorter distance from the central axis of the cap that the lateral regions of the inner annular bead, which are interrupted by the slots. The region of the inner annular bead located on the side opposite the actuating side may also be at a shorter distance from the central axis of the cap than the intermediate regions of the inner annular bead, located between the actuating side and the opposite side.

In this embodiment, again, the fixing device of the cap may comprise a part constructed as a supporting member and firmly mountable on the bottle neck below the bottle mouth, on which supporting member the cap is borne, in a manner which permits swivelling, on the side of the bridging member.

As an additional sealing element, it is possible to provide, around the stopper, a sealing collar which projects inwards from the upper inner wall of the closure device and which is elastically deformed in the closing position so that it rests sealingly on the frontal face of the bottle mouth.

Both in the first-described and in the preferred embodiment of the closure according to the invention, the sealing collar may be of circular cross-section at its foot, which adjoins the inner wall of the cap, and be of elliptical cross-section at the free rim of the collar when the cap is in the open position, with the major axis of the ellipse extending from the bridging member to the opposite side wall of the cap and with the distance of the free rim of the collar from the foot of the collar being constant.

According to another embodiment, the sealing collar may have a circular cross-section at its foot which adjoins the cap inner wall and at the free rim of the collar, and axial cut-out emanating from the free rim of the collar can be provided so that the segments, left between the cut-outs, of the collar wall which adjoins the free rim of the collar are pushed together in the closing position and sealingly rest against the frontal face of the bottle mouth.

Finally, in a third preferred embodiment, the sealing collar can comprise a stiffened sealing ring and the collar wall which connects the said ring to the foot of the collar can have a slightly deflectable foot wall zone, adjoining the foot, a more flexible and more elastic bending zone which adjoins the foot wall zone, and a more rigid neck zone, carrying the ring, the ring being thickened so that when it rests against the frontal face of the bottle mouth a free space remains between this frontal face and the collar wall, which space, in the first-described embodiment of the closure, is in communication with the external air through axial slots in the side wall of the cap. Such additional sealing element has been described in the co-pending application Serial No. 641,076 filed on even date with this application by one of us, Walter Zapp.

Finally, the stopper can be sealed from the inside of the bottle by a cross-wall below the chamfer, and the space surrounded by the stopper can be open in an upward direction. At the same time, the cross-wall of the stopper can be thickened and joined by a flexible annular zone to the end of the champfer of the stopper.

Further particulars of the invention will be seen from the following description of preferred embodiments thereof in conjunction with accompanying drawings, wherein FIG. 1 shows a preferred embodiment of the bottle closure, as an internal view of the inside of the closure, as obtained when manufactured as an injection molding;

Figure 3:
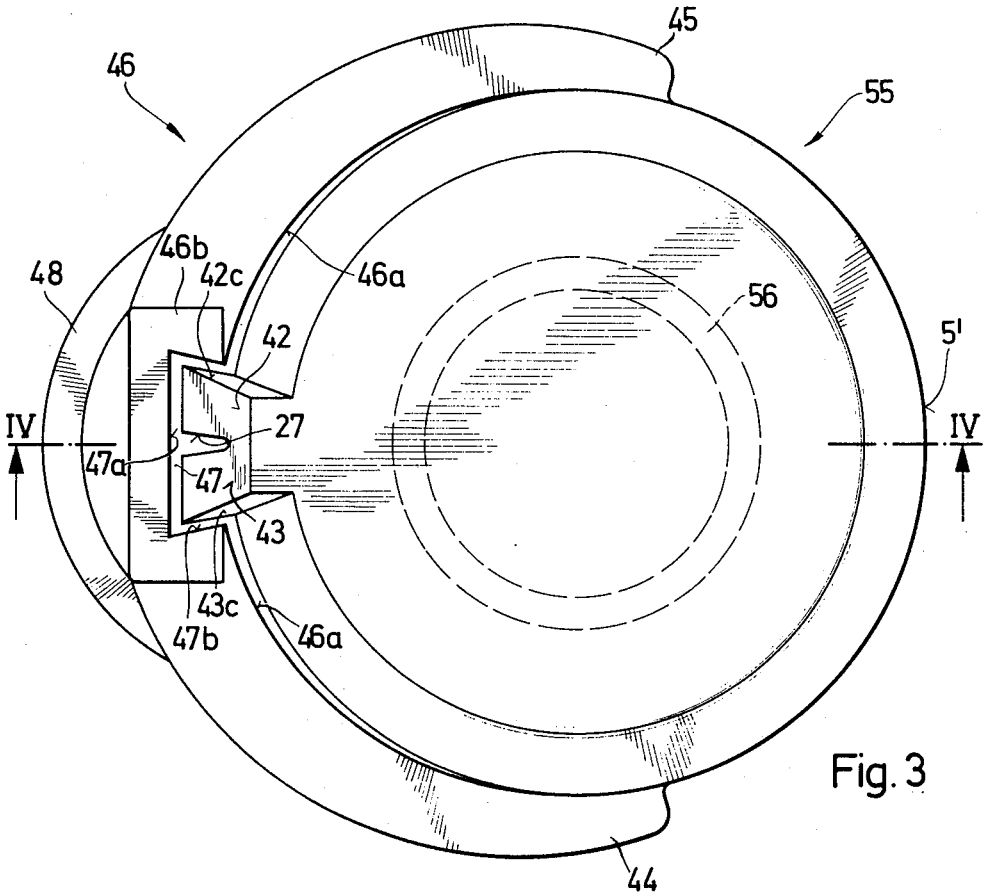
FIG. 3 shows a top view of an embodiment similar to that shown in FIGS. 1 and 2, the closure being shown in the form resulting from its manufacture, before it is fixed to a bottle neck.
Figure 4:
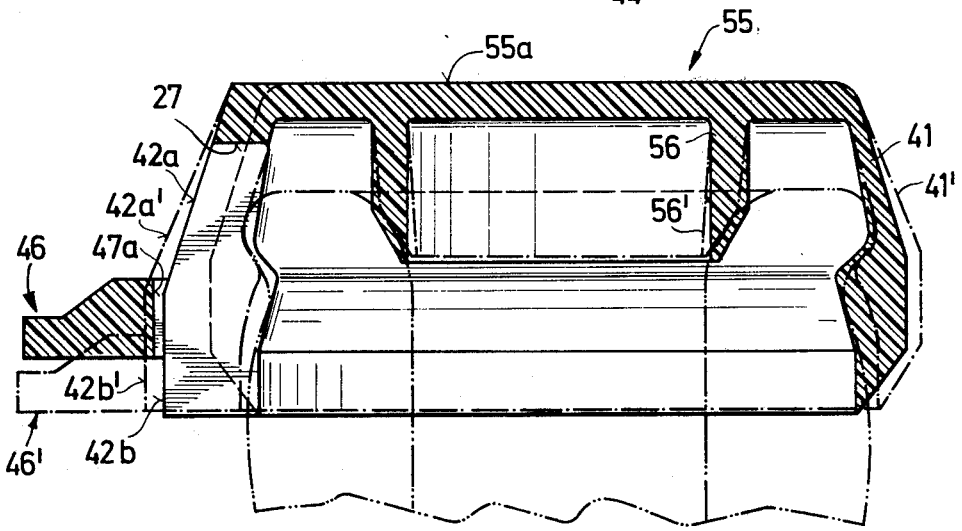

FIG. 4 shows a cross-section through the embodiment shown in FIG. 3, in a plane indicated by IV—IV in FIG. 3, whith the solide lines indicating the closure before mounting on a bottle neck and the broken lines showing the same closure in the altered position after mounting on a bottle neck, the shading having been partially omitted for the sake of clarity and the bottle neck being indicated by dash and dotted lines.

Figure 5:
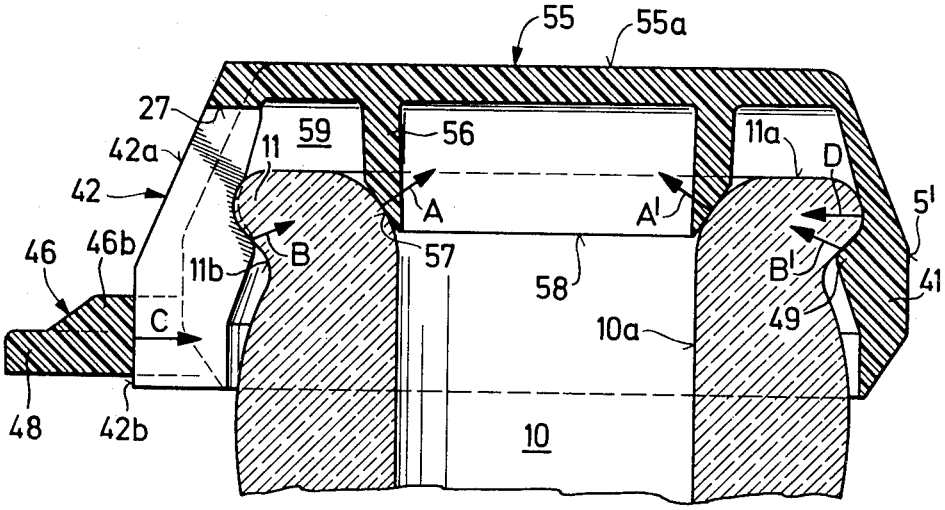
Figure 6:
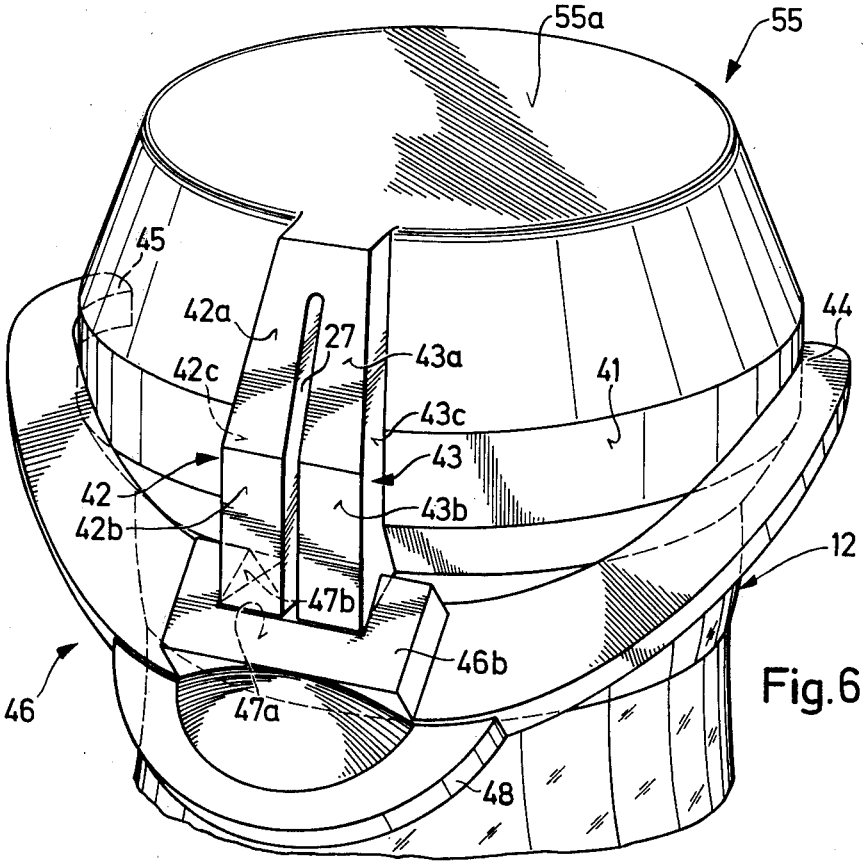
Figure 7:
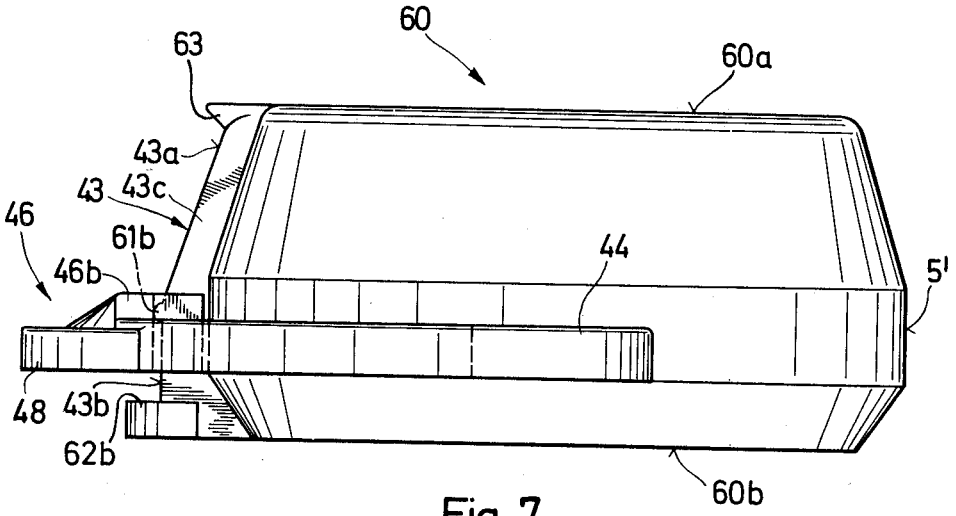
Figure 8:
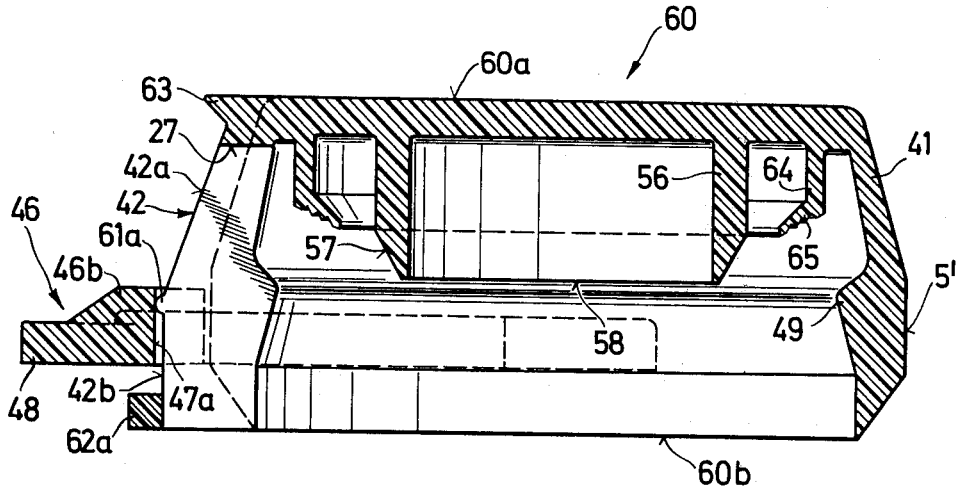
Figure 9:
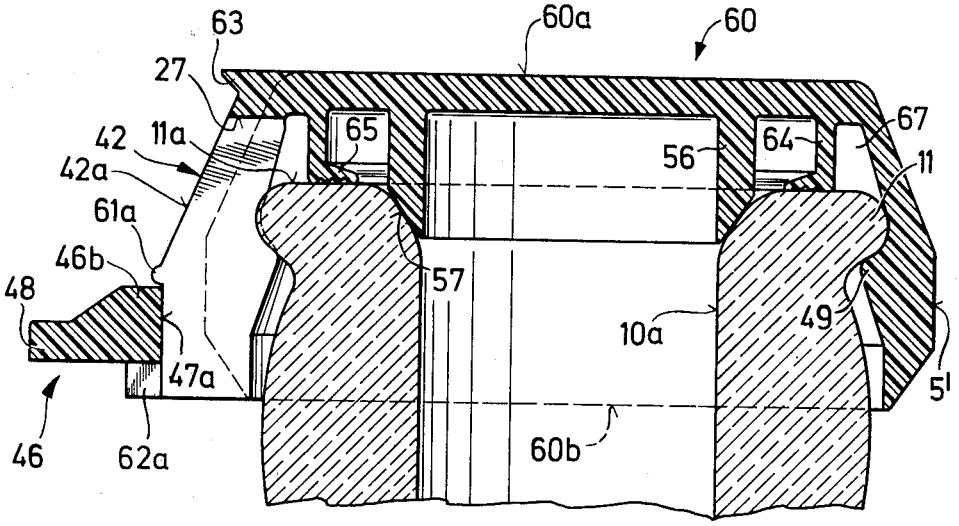
Figure 10:
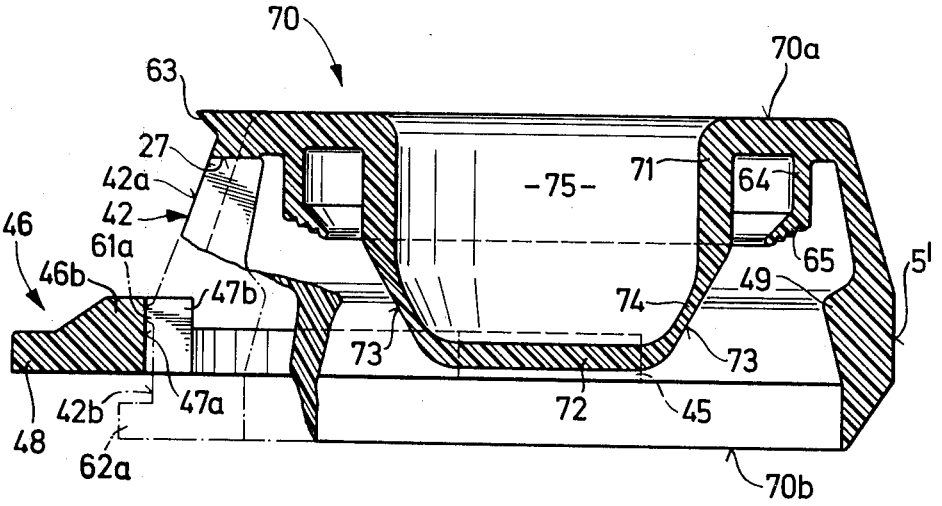
Figure 11:
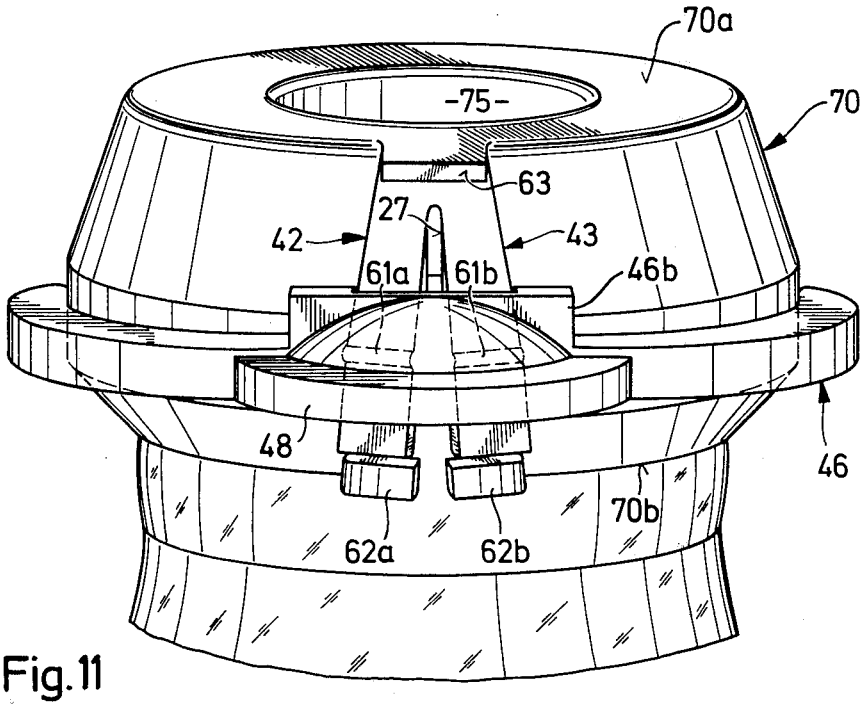
Figure 12:
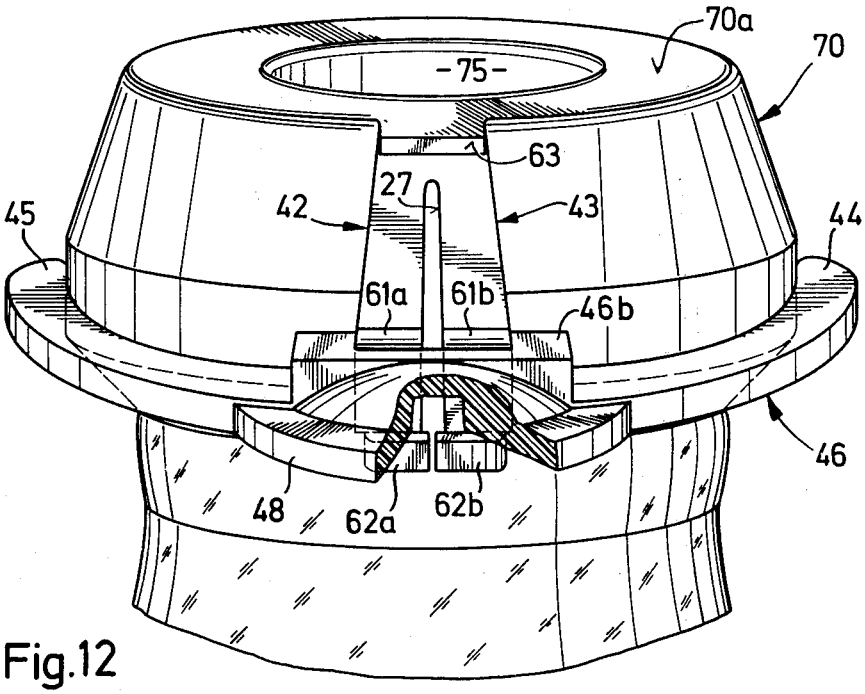
Figure 13:
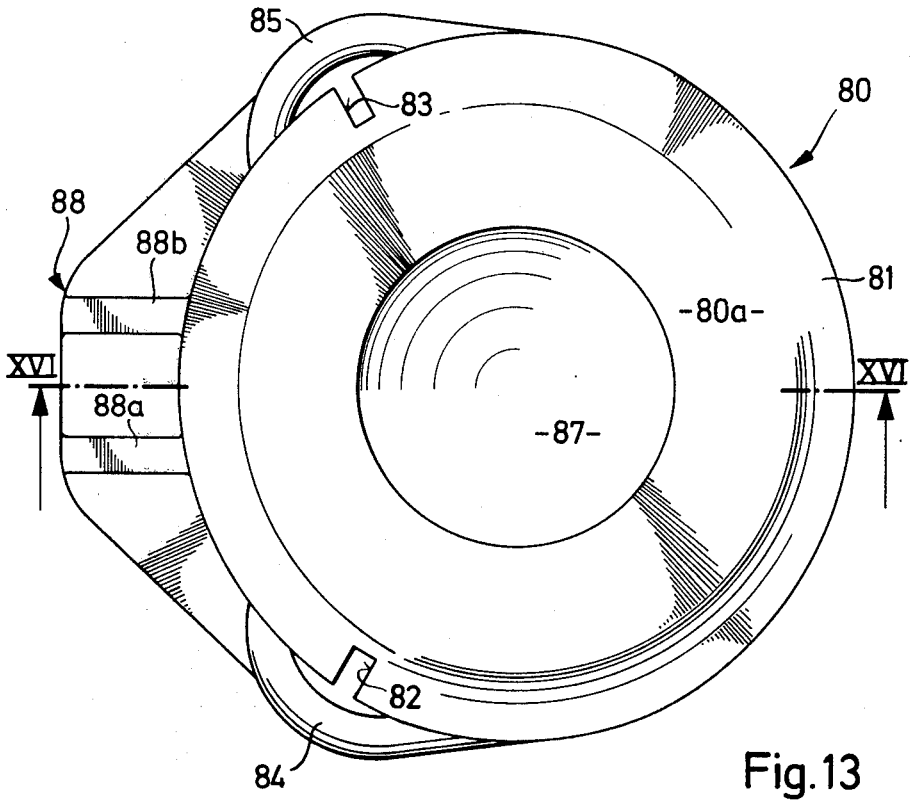
Figure 14:
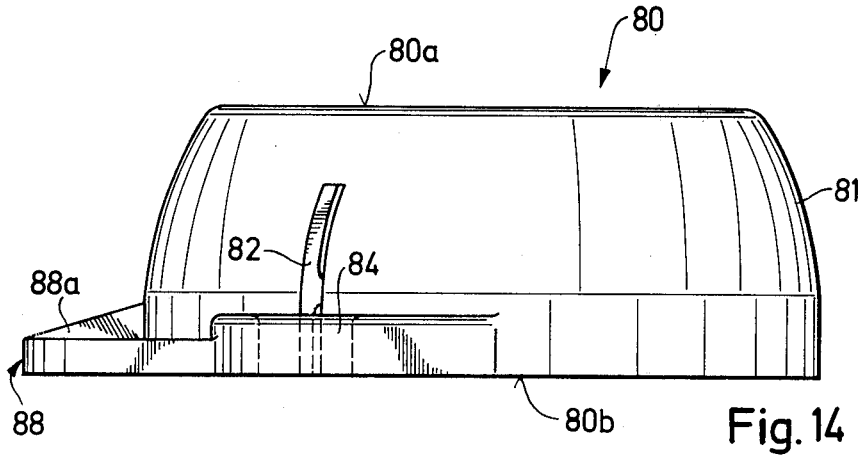

FIG. 5 shows the same closure, in cross-section, as in FIG. 4, but only in the position wherein the closure is mounted on a bottle neck;

FIG. 6 shows a perspective view of a closure mounted on a bottle neck, in one of the embodiments shown in FIGS. 1 to 5, with the ring member moved fully downwards against the bottle;

FIG. 7 shows a side view of a further, particularly preferred embodiment of the closure according to the invention;

FIG. 8 shows a cross-section through the embodiment according to FIG. 7 before mounting on a bottle neck and FIG. 9 shows the same closure in cross-section, but after mounting on a bottle neck;

FIG. 10 shows yet a further embodiment of the closure according to the invention in a cross-section and partly exploded;

FIG. 11 shows a perspective view of the actuating side of the closure according to FIGS. 7 to 9, mounted on a bottle, before tensioning by means of the ring member;

FIG. 12 shows the same closure as in FIG. 11, but in the position wherein it is tensioned by means of the ring member;

FIG. 13 shows a top view of a further, particularly simple and easily manufactured embodiment of the closure according to the invention;

FIG. 14 shows a side view and

Figure 15:
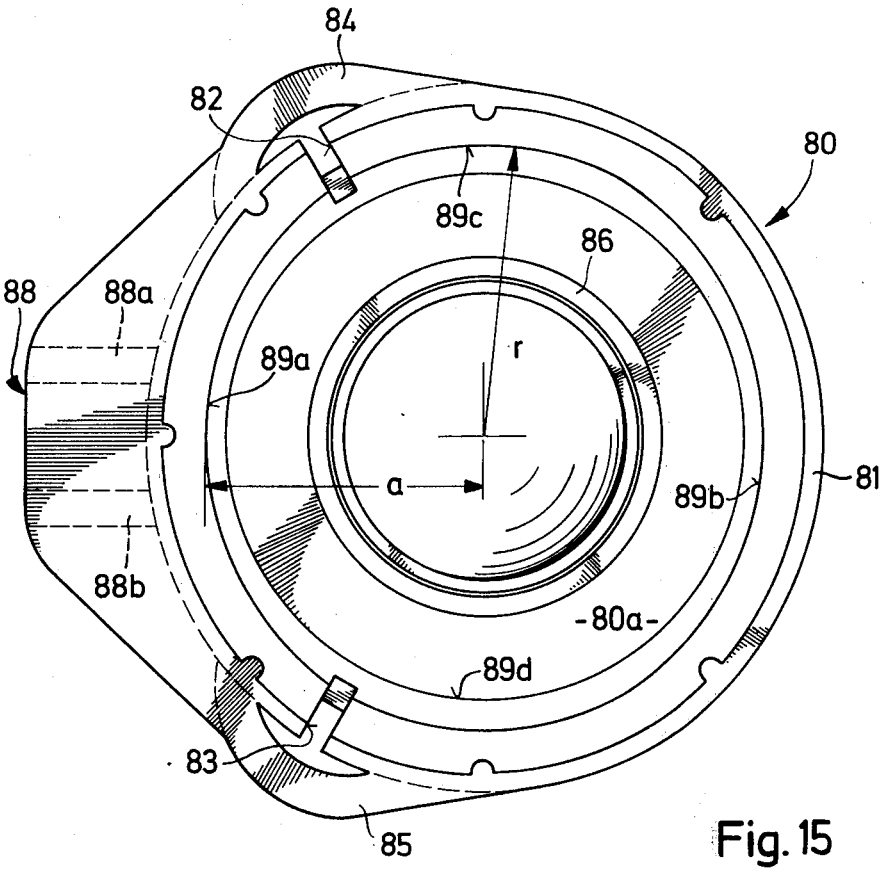
Figure 16:
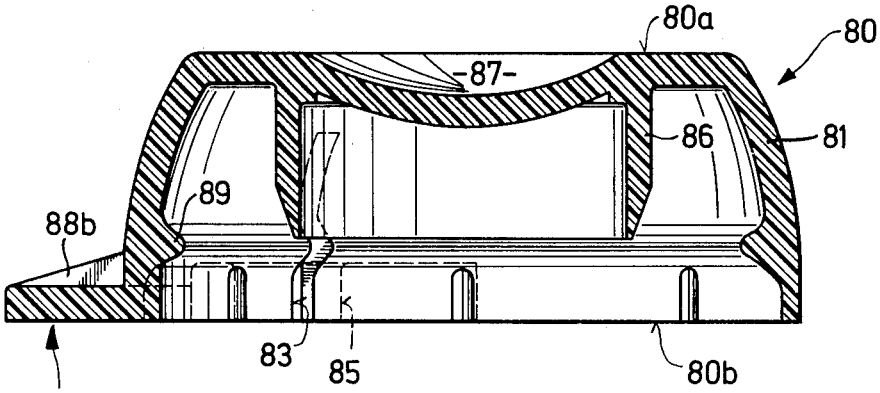
Figure 17:
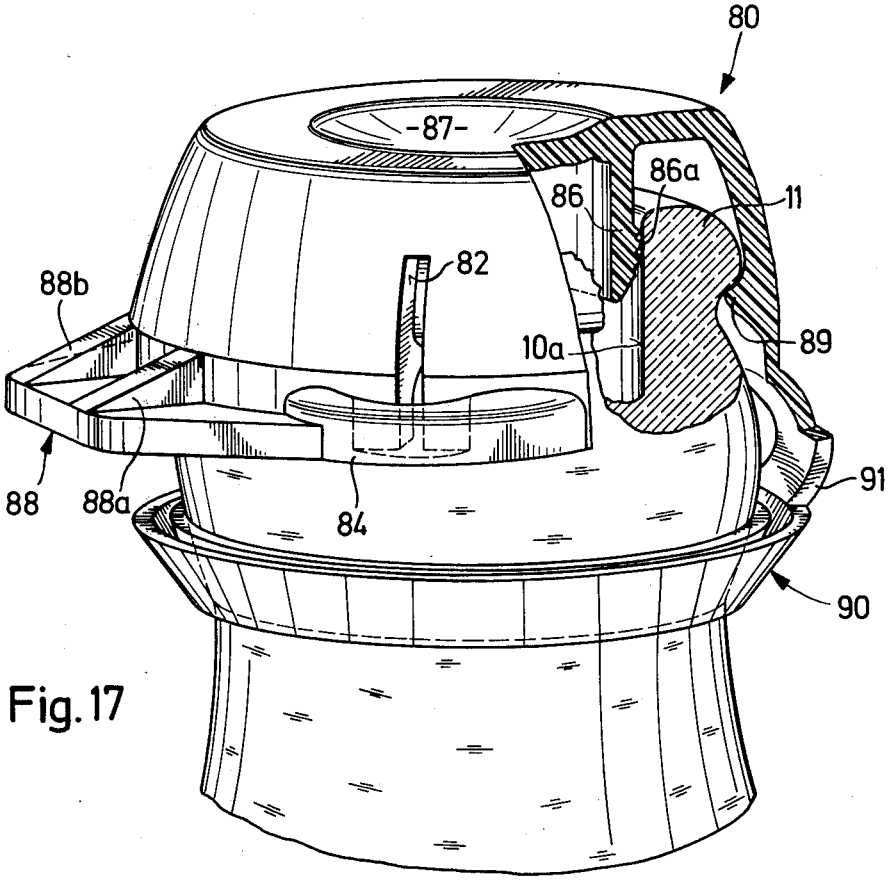

FIG. 15 shows an internal view of the embodiment according to FIG. 13;

FIG. 16 shows a cross-section through the same embodiment as in FIG. 13, along the plane indicated by XVI—XVI in FIG. 13, and finally FIG. 17 shows a partly sectional view of an embodiment resembling that of FIGS. 13 to 15, of the closure with a supporting member, mounted on a bottle neck.

Figure 1:
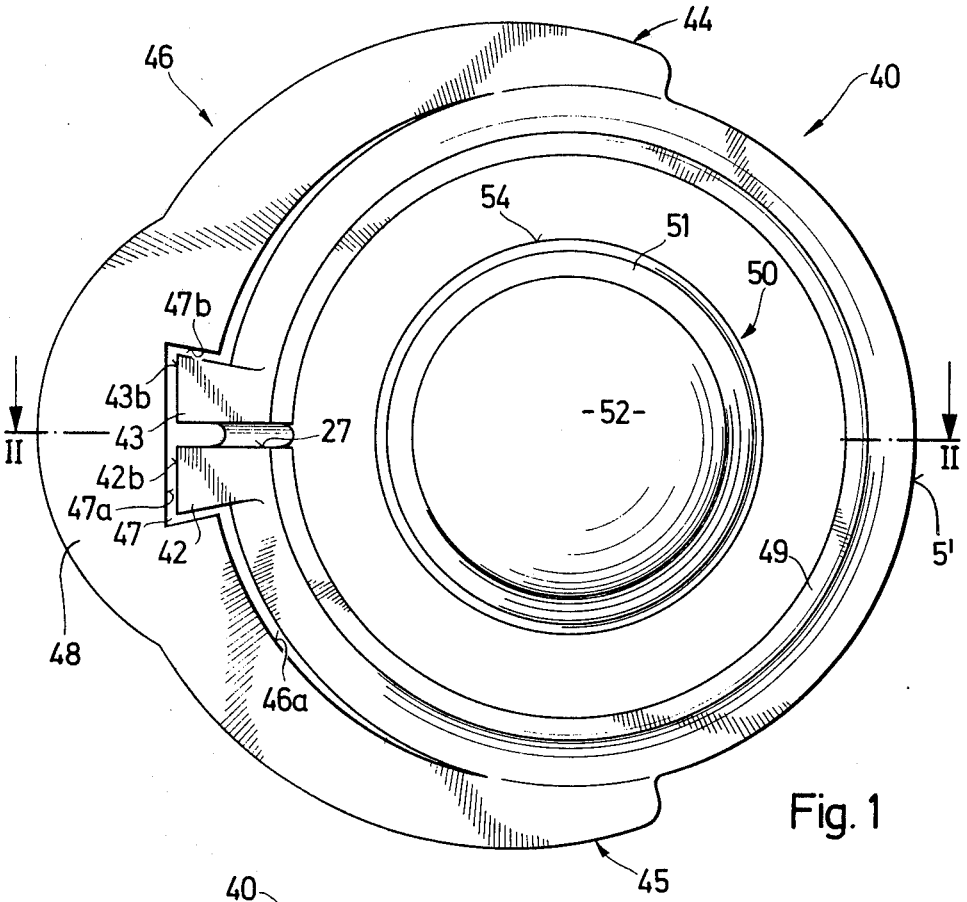
Figure 2:
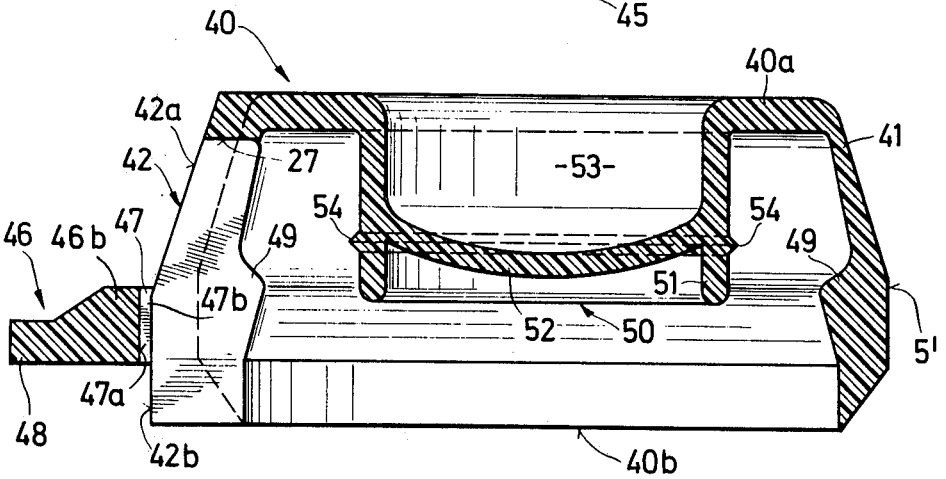
FIG. 2 shows a cross-section through the same embodiment, along the plane indicated by II—II in FIG. 1.

The embodiments of the closure according to the invention shown in FIGS. 1 to 6 are substantially simplified in construction and manufacture. The closure device shown in FIGS. 1 and 2 is constructed as a cap 40 and has an upper wall **40*a* with a central stopper recess 53 surrounded by a sealing stopper part 50, of which the approximately cylindrical side wall 51 bears a peripheral sealing bead 54, whilst the recess 53 is separated from the inside of the bottle by a crosswall 52. With the closure mounted on the bottle neck, the stopper part 50 projects into the bottle mouth 10, with the sealing bead 54 resting against the inner wall of the mouth, as is known, eg., from U.S. Pat. No. 3,825,144 to Walter Wiedmer. As is known, such a stopper part has the advantage that the volume of air above the liquid in the as yet unopened full bottle is substantially less than in the case of the embodiment of FIGS. 3 and 4**.

The cap side wall 41 extends downwards from the preferably circular periphery of the upper wall 40*a* of the cap 40 and possesses, on its actuating side, a single slot 27 which extends from just below the upper wall 40*a* down to the lower peripheral rim 40*b* of the cap 40, and opens out into the said rim.

On the inner face, the cap side wall 41 carries an inner bead 49 which extends round in a circle and which is intended to hook under the orifice bead 11 at the upper end of the bottle neck.

Outward-projecting ramps 42 and 43 are provided as a tensioning device on either side of the slot 27; these ramps extend from the peripheral rim of the upper wall 40*a* of the cap 40, to the right and left of the slot 27, down to the lower peripheral rim 40*b* of the cap 40. The frontal faces of the ramps 42, 43 are constructed, in the upper region, from the upper wall 40*a* to the intermediate region of the cap side wall, which is approximately at the level of the inner bead 49, as conically outward-chamfered slide faces 42*a*, 43*a* cross-section of the tensioning groove 47 in the plane of the ring is of dovetailed shape. As may be seen from FIG. 2, the tensioning groove 47 is continuous from the upper to the lower face of the ring member 46, and the latter has a block-like thickening 46*b* on its surface, which increases the length of the tensioning groove. In front of the block-like thickening 46*b* the ring member 46 carries an actuating nose 48, against which is placed, eg., the thumb of the hand which operates the closure.

In the embodiment according to FIGS. 3 to 6, corresponding parts carry the same reference numbers as in the embodiment of FIGS. 1 and 2.

The only difference from the latter embodiment is that the cap 55, in this embodiment, does not have a stopper part with a recess but instead a stopper 56 which projects as a depending sleeve from the inner face of the upper wall 55*a* of the cap 55 in the direction of the inside of the bottle. The outer side wall of the nozzle has a conically chamfered sealing surface 57, extending down to the lower rim 58 of the stopper sleeve, in the region above and below the transition zone from the frontal face to the inner wall 10*a* of the bottle neck.

During mounting of the closure on a bottle mouth, and also after mounting the closure, the annular space 59 which surrounds the stopper sleeve 56 on the inside of the cap is constantly in communication with the external air through the slot 27.

FIGS. 1 to 3 show the closure according to the invention as obtained from its manufacturing process, and before mounting on a bottle. The gap which, in this state, is open between the inner face 46*a* as well as the lateral surfaces 47*b* and bottom surface 47*a* of the tensioning groove 47, on the one hand, and the outer surface of the cap side wall 41 and the sides and frontal faces of the ramps 42 and 43, on the other, permits extremely simple release of the molding off its core if the closure is manufactured by injection molding.

FIG. 4 shows a cross-section of the embodiment contact-making to FIG. 3 with solid lines corresponding to the same condition as in the latter figure, the shading being partially ommitted for clarity, whilst the broken lines show the same embodiment in position on the bottle mouth. As may be seen from FIG. 4, on mounting the closure on the bottle mouth, the cap side wall 41 is splayed to assume position 41' whilst the ring member 46, which previously was so located as to leave play between its tensioning groove bottom surface 47*a* and the contactmaking surface 42*b*, now — on being pressed down into the position 46' shown by broken lines — presses, with the bottom surface of the tensioning groove, against the stop surface 42*b'* of the ramp 42 (or 43) which has moved outwards, together with the cap side wall 41, and as a result compresses the slot 27 and produces the same sealing circumferential tension in the inner bead 49 of the cap side wall as is the case in the embodiment according to FIGS. 1 to 14, as a result of the toggle action of the stays 6 and 7, described in the aforesaid co-pending patent application Ser. No. 641,076 filed on even date herewith.

Hereby, the slot 27 is narrowed through the side surfaces 47*b* of the tensioning groove 47 making contact with the lower region of the outer side surfaces 42*c* and 43*c*, with consequent compression of the ramps 42 and 43.

The stopper sleeve 56 is also deformed as a result of its conical end-face 57 (see FIG. 5) making contact with the transition rim — which in most cases is extremely non-uniform — from the mouth frontal face 11*a* to the inner wall 10*a* of the mouth 10, this deformation being shown in broken lines at 56'.

FIG. 5 now shows the closure mounted on the bottle mouth. Herein, arrows A, A', B, B', C and D indicate the way in which the cap side wall 41 carrying the bead 49, the stopper sleeve 56 with its chamfered outer end face 57 and the contact-making surface 42*b* together with the tensioning groove bottom surface 47*a* (FIG. 3) all interact in this position to achieve the desired sealing tension of the closure.

Since the annular space 59 which surrounds the stopper sleeve 56 within the cap 55 is constantly in communication with the external air through the slot 27, mounting the closure on the bottle neck, in contrast to known closures, does not produce, in this annular chamber, an excess pressure as a result of which air could additionally be forced past the conical end face 57 of the stopper sleeve 56 into, the inner space of the bottle mouth 10, above the material contained in the bottle.

The interaction, which narrows the slot 27, of the side surfaces 47*b* of the tensioning groove 47 with the outer side surfaces 42*c* and 43*c* of the ramps 42 and 43 is maintained, as may be seen from FIG. 19, even when the ring member 46 has been swung downwards, by means of its actuating nose 48, against the outer wall of the bottle neck to the point that the tensioning groove bottom surface 47*a* can no longer act against the contact-making surfaces 42*b* and 43*b* of the ramps 42 and 43, in the direction of the arrow C (FIG. 5).

In the improved embodiment, according to FIGS. 20 to 22, the cap 60, having an upper wall 60*a* and a lower peripheral rim 60*b* has a smaller configuration to that in the embodiments of FIGS. 14 to 19, but the ramps 42 and 43 possess, in their central region, at the point of transition from the slide surfaces 42*a* and 43*a* to the contact-making surfaces 42*b* and 43*b*, transverse beads 61*a* on ramp 42 and 61*b* on ramp 43, which prevent an unintended upward slippage of the ring member 46, by the tensioning groove bottom surface 47*a*, from the contact-making surfaces 42*b* and 43*b* onto the slide surfaces 42*a* and 43*a*. Furthermore, stop noses 62*a* and 62*b* are provided on the lower ends of the ramps and prevent the ring member 46 from swinging downwards into the position shown in FIG. 6.

Finally, as may be seen from FIGS. 8 and 9, a sealing collar with a foot part 64 and flexible upper part 65 of the collar is provided on the inside of the upper wall 60*a;* this collar provides an additional means of sealing, as has already been described in detail for the embodiment of the closure of FIGS. 1 to 13, and especially also in connection with FIGS. 7 and 8, of the co-pending patent application Ser. No. 641,076 filed of even date herewith.

It is particularly important that the additional sealing collar 64 should, in the embodiment of FIGS. 8 to 10, rest by its flexible upper part 65 against the frontal face 11*a* of the mouth of the bottle neck in such a way that its rim should point towards the stopper sleeve 56. This achieves a self-sealing effect which is absent in the sealing elements described in French Pat. No. 1,342,700, to Krygler.

FIG. 10 shows a further particularly preferred embodiment in which the advantages of the stopper sleeve 56 in the embodiments of FIGS. 4 to 9 are combined with those of the socket-type part of FIG. 2.

The cap 70 with upper wall 70*a* and lower peripheral rim 70*b* possesses in this embodiment, at the lower end of the sealing surface 73 — which end tapers towards the inside of the bottle — the cavity 75 in the upper wall 70*a* and the stopper sleeve 71 has a cross-wall 72 of greater wall thickness which is joined to the lower end of the stopper sleeve by a particularly thin-walled elastic transition zone 74.

Furthermore, it is here once again possible to achieve an additional seal by means of the sealing collar 64 having a flexible upper part 65, but in most cases the good seal achieved by contact of the surface 73 against the rim zone between the frontal face 11*a* of the bottle mouth and the inner wall 10*a* of the mouth 10 is adequate, due to the interaction of the forces represented by the arrows in FIG. 5.

The embodiments of the closure of the invention, described above, have successfully withstood a rise in internal pressure of up to 8 atmospheres gauge, due to increased ambient temperature and shaking, in the case of bottles filled with a liquid under pressure, e.g. beer or carbonated mineral water.

Finally, FIGS. 11 and 12 show a closure in the embodiment of FIG. 10 mounted on a bottle mouth; FIG. 11 shows the closure with the ring member 46 in the released position and FIG. 12 with the ring member 46 in the tensioned position, the actuating end of the ring member 46 resting on the stop noses 62*a* and 62*b* and being prevented from unintentionally slipping upwards, and releasing the tension, by the transverse beads 61*a* and 61*b*. If the ring member 46 is raised further from the position shown in FIG. 11 by pressing the thumb against the actuating nose 46*b*, it strikes the upper stop nose 63 and now lifts the untensioned cap off the bottle mouth, little force being required.

To act as a tamperproof seal to indicate that a filled bottle has not yet been opened, a seal can be glued or welded over the slot 27 and upper surface of the thickening 48 of the ring member 46 which is the closing position of FIG. 12, this seal only being torn off or forced off when the bottle is first opened by lifting the ring member 46.

In the embodiment of the closure shown in FIGS. 13 to 17, which is of particularly simple construction and easy to manufacture, e.g. by injection molding, the cap 80 has an upper wall 80*a* and a side wall 81. The latter has two slots 82 and 83 which extend in the axial direction from near the upper wall 80*a* to the lower peripheral rim 80*b* of the cap side wall 81, and open out into said rim. The two slots 82 and 83 are each staggered by 60° from the actuating side, on which the cap 80 carries an actuating nose 88 with two stiffening parts 88*a* and 88*b*, towards the opposite side of the cap. At each of the slots 82 and 83, a tensioning stay, respectively 84 and 85, which bridges the slot 82 or 83 and is articulatedly connected to the cap side wall 81 on either side of the slot 82 or 83, is provided near the peripheral rim 80*b* of the cap. An inner annular bead 89 projects from the inner surface of the cap side wall 81 and in the closing position the upper face of this bead presses against the underside of the orifice bead 11 of the bottle neck.

Preferably, the distance *a* of region 89*a* of the inner annular bead 89 from the central axis of the cap is less than the distance *r* from the intermediate regions 89*c* and 89*d* of the inner annular bead 89, which respectively comprise the slots 82 and 83 and are located between the actuating side and the opposite side. The distance of the region 89*b* of the inner annular bead 89 on the side of the cap 80 which is opposite the actuating side is also preferably less than the distance *r*.

As a result, the inner annular bead 89 engages, with its regions 89*a* and 89*b*, on the actuating side and opposite side, respectively, more deeply in the constriction under the orifice bead 11, which facilitates a lever-like lifting of the cap 80 by means of its actuating nose 88.

On pressing the closure into the mouth of a bottle neck, the lower peripheral rim 80*b* passes the orifice bead 11 of the bottle, thereby splaying the slots 82 and 83 and at the same time tensioningly stretching the tensioning stays 84 and 85. Once the inner annular bead 89 has been forced past the orifice bead 11, the tensioning stays 84 and 85 contract so as to compress the open ends of the slots 82 and 83 and thus increase the pressure of the surface of the inner annular bead 89 against the underside of the orifice bead 11 on all sides, in the same way as is effected in the previously described embodiments of the closure by the stays 6 and 7 or by the interaction of the ramps 42 and 43 with the tensioning groove 47 of the crescent-shaped ring member 46.

On the inside of upper wall 80*a* of the cap is provided a stopper sleeve 86 which can be constructed in the same way as in the preceding embodiments of the closure. Within the periphery of the stopper sleeve 86, the upper wall 80*a* has a downward dome 87 which serves to increase the pressure of the upper face of the inner annular bead 89 against the underside of the orifice bead 11 as the pressure inside the bottle mouth rises. Furthermore, the outer wall of the stopper sleeve 86 can be provided with a plurality of parallel annular beads 86*a* (FIG. 16), by means of which a seal resembling a labyrinth seal is achieved when they rest against the inner wall 10*a* of the bottle mouth or the rim where the latter adjoins the frontal face 11*a* of the mouth.

In the embodiment of the closure shown in FIG. 16, the cap 80 has a supporting member 90 resembling the supporting member 1 in the embodiment first described. The supporting member 90 is joined, preferably integrally, to the cap 80 by a strap-joint 91. The manufacture of this embodiment of the closure by injection molding is most simply achieved with the supporting member and the cap in the relative position shown in FIG. 13 of the co-pending application Ser. No. filed of even date herewith.

In the case of the embodiment including a supporting member, the cap does not jump off on opening the closure and as a result the bottle can easily be washed whilst leaving the opened cap attached thereto, and can then be reclosed.

On the other hand, it is also possible to provide a sealing web in the slots 82 and 83 (this web not being shown in the drawing) to indicate that the bottle has not yet been opened after filling; on mechanically mounting the cap on the filled bottle, this operation being carried out vertically along the direction of the central axis of the cap, this web stretches and thereby withstands the splaying of the slots 82 and 83, but on lifting the cap 80 with a finger, which is a one-sided operation entailing the lifting of the actuating nose 88, the web tears because of the less uniform distribution of the tension.

A particularly surprising feature of this simple and easily manufactured embodiment is that it withstands a rise in pressure to 6–8 atmospheres gauge in the free space above the bottle contents, which may be, e.g., beer or similar carbonated drinks. Higher pressures are attainable by appropriate design of the tensioning device, e.g. by using thicker tensioning stays, but this is not permissible because it entails the risk of explosion of the bottle. The closure permits pasteurising of the bottle contents.

The most important advantages of the new closure are, firstly, that substantially less force is required for opening and closing than in the case of the known closure described at the outset, since the opening and closing can easily be effected by lifting the clasp member, or actuating nose, of the ring member or the cap, by means of one finger, as is indicated, e.g., in FIG. 12 of co-pending patent application Ser. No. 641,076 filed of even date herewith.

The customary and permissible tolerances in dimensions of the bottle neck cannot interfere with the firm seat and reliable functioning of the new closure. The closure is leakproof even if the dimensional tolerances are large, e.g. up to 1 mm. The relatively high elasticity and adaptability of shape of the material which may be used for the new closure facilitates compensating such dimensional tolerances. Finally, the closing pressure used can be much less than the permissible maximum internal pressure of the bottle.

To avoid soiling of the outside of the bottle after pouring out of liquid it is possible, in the first-described embodiment of the closure according to the invention, to provide a trough-like or pocket-like recess, which serves as a drip-catcher, in the region of the supporting member opposite to the side carrying the bridging member.

In bottle closures according to the invention manufactured particularly simply by injection molding from a plastic e.g. Lupolen 1800 S of BASF, Ludwigshafen, West Germany, the ring member, the cap and the bridging member which joins the latter to the ring member, and, if present, the supporting member and the strap-joint which joins it to the ring member, may all be molded integrally. In the latter case, where a supporting member is present, injection molding is most simply effected in the position where the cap and the ring member are at an angle of 180° to the supporting member. This also has the advantage that the cap and ring member have a bias urging them into the open position.

The invention thus realises a bottle closure which can be opened and reclosed easily, with one hand, in contrast to the known closure described at the outset, and without tools, in contrast to a crown closure. If a supporting member is present, the closure remains joined to the bottle and can thus automatically be returned with the empty bottle, to a filling station. However, the closure does not interfere with drinking from the bottle and can be pulled off the bottle quite simply before the bottle is cleaned in an upside-down position on the modern washing machines used in filling stations.

Where necessary, the bottle closure with supporting member can, shortly before the bottles are washed on the said machines, be pulled upwardly off the bottle by a simple mechanical gripper, e.g. with gripper jaws with a knife-edge construction on the insides, whereby the closure is also slit open whilst being pulled upwards. In the preferred simpler embodiments of the closure, the latter is removed before washing the bottles. In that case, after each fill of the bottle, a new closure can be mounted on the bottle neck mechanically, by exertion of simple vertical pressure, the filled bottle being tightly sealed thereby. The closure can in particular be used for standard bottle mouths (SNV-79,100).

Though the closure can very conveniently be opened with one hand, it nevertheless offers good protection against unintended opening. Where the cap has an inward-pointing stopper part, the filled bottle can be closed so as to leave very little air above the contents.

The dispensing orifice is covered by the cap closure, similarly to the situation with a crown cork, and this offers an improvement in hygiene over the old strap closure and the known closure described at the outset.

In contrast to the previously known plastic caps, the seal is not effected against the inner wall of the mouth, the internal diameter of which, being dependent on the amount of material used when blowing the bottles, suffers from particularly wide tolerances, so that a high sealing pressure is required; instead, the seal is effected at the transition zone from the frontal face of the upper, weld-free rim of the mouth to the inner wall of the bottle neck, the outer dimensions of the bottle, up to the mouth, being determined by the mold and tolerances of up to 1 mm being immaterial.

However, whilst with the known closures, the seal must be effected with a high contact pressure, which exceeds the maximum internal pressure of 8 to 10 atmospheres gauge, the sealing element of the closure according to the invention only requires a moderate pressure, sufficient to effect the initial seal on the stopper sleeve and, where relevant, on the sealing collar. As the internal pressure rises, a good high pressure seal is achieved, according to the invention, if the latter is used, in that the internal pressure on the inside of the collar-shaped sealing element of the closure according to the invention has a similar effect to that in tubeless automobile tires, and presses the sealing collar self-sealingly against the frontal face of the bottle mouth.

The phrase "bottle or the like" means any type of container which has a neck with a preferably central dispensing orifice, the neck wall having the shape described at the outset; it is immaterial whether the container supporting this neck is of circular cross-section, as in the case of, e.g., a beer bottle, mineral bottle or wine bottle, or of square cross-section, as is the case, e.g., with many liqueur bottles, or is constructed as a "bag in a box" or as any other design which may be desired. Furthermore, this container may be made of glass, ceramic, plastic and even metal. It may be filled with a liquid but can also be filled with a granular solid.

Wherever the terms "top" and "bottom" are used in the preceding description, they relate to the position of the closure according to the invention, especially in the cross-sectional views and the perspective side elevations.

Similar remarks apply to the terms "upwards" and "downwards".

In order to employ, as far as possible, a consistent nomenclature for the various sides of the cap side wall, the side of the cap side wall opposite to the actuating side has been described as the "opposite side" or "hinge side" 5′ also for the preferred embodiments of the closure according to the invention, as shown in FIGS. 14 to 25, though the ring member which, in these embodiments, is crescent-shaped, is articulatedly connected to the cap in the two central intermediate regions of the cap side wall.

The term "inwards" denotes a movement in the direction towards the inside of the bottle mouth, that is to say downwards, whilst "upwards" denotes a movement out from the inside of the bottle, that is to say upwards.

The term "slotting" of the cap side wall means that this wall possesses one or more cut-outs or slots which are open at the lower peripheral rim of the cap and extend axially towards the upper wall of the cap. Whilst these slots are broad in the known closure described at the outset, the slots in the closure of the present invention are preferably narrow.

We claim:

1. A closure which serves to close hermetically, but in an easily reopenable manner, a bottle or similar container, which possesses a neck having a dispensing orifice, a neck frontal face surrounding said orifice and an orifice bead located below the latter and having a constricted underside, and which closure comprises a. a cap serving as the head of the closure and having an upper cap wall and a cap side wall circumferential about said upper cap wall and possessing slot means extending from the lower rim of said cap side wall and transversely to said rim, to permit said cap side wall to splay on being mounted on the mouth of the bottle, said cap side wall having an inner annular bead projecting inwards from the inner face of said cap side wall and destined, in the closing position, to engage with the constricted underside of the orifice bead of the bottle, b. a sealing element provided on the inner face of the upper cap wall and serving, in the closing position, to seal the dispensing orifice of the bottle, c. a lifting element which may be actuated by the finger and is located on an actuating side of the cap, and d. fixing means which peripherally bridge each slot present in said cap side wall, at least when in the closing position, by sealingly pressing said inner annular bead of the cap side wall against the constricted underside of the orifice bead of the bottle, said fixing means being linked to the cap side wall in at least one region, remote from the actuating side of the cap side wall, said fixing means comprisng tensioning means which, in the closing position, are tensioned by being stretched tangentially to the cap side wall in a direction toward said actuating side and as a result effects a compression of each slot present in the side wall and provides a uniform pressure, from all sides, of the inner annular cap bead against the underside of the orifice bead of the bottle neck.

2. A closure as described in claim 1, wherein said ring member possesses a recess, running transversely to the plane of the ring, on its inner wall opposite each slot, whilst the tensioning means comprise, on either side of each slot, ramp portions which project from the outer face of the side wall of the cap, the said ramp portions projecting, in the region of the lower peripheral rim of the cap, so far that the bottom surface of the recess of the ring member, when the latter is moved downwards into the closing position, runs onto the ramps and tensions the ring member in the direction away from the central axis of the cap.

3. A closure as described in claim 2, wherein said ramps are broadened out in the direction of the lower peripheral rim of the cap so that the side walls of the recess in the ring member, when the latter is moved downwards into the closing position, run onto the ramps so as to compress them and narrow the slot between them.

4. A closure as described in claim 2, wherein said recess has a dovetail-shaped cross-section.

5. A closure as described in claim 2, wherein said ramps each possess, in an intermediate region between the upper face and the lower peripheral rim of the cap, a hump over which the bottom surface of the recess of the ring member must be forced when it is pushed into the closing position.

6. A closure as described in claim 2, wherein said recess in the ring member is so constructed that even when the ring member is completely swung downwards until it rests against the bottle neck the side walls of the recess remain in contact with the outer faces of the ramps and compress the recess so as to narrow the slot.

7. A closure as described in claim 2, wherein said ramps possess, at their lower ends, stop noses which prevent downward movement of the recess of the ring member beyond the lower rim of the ramps.

8. A closure as described in claim 2, wherein said cap possesses a stop above the ramps, against which the ring member strikes when raised, thereby lifting the cap from the neck of the bottle.

9. A closure as described in claim 2, wherein, in the state of the closure before it is mounted on the bottle, there is a sufficient air gap, on the one hand, between the ramps and the adjacent regions of the cap side wall which extend away from the actuating side towards the opposite side, and, on the other hand, between the bottom surface and the side walls of the recess and the regions of the the ring member which adjoin either side of the recess, in the plane of the ring, so that it is possible to manufacture the closure integral with the ring member on the actuating side slightly above the zone in which the ring member runs onto the ramps.

10. A closure as described in claim 2, wherein said ring member is constructed as an arc and is hinged to either side of the cap at positions of the side wall of the cap which are displaced from the non-actuating side towards the actuating side.

11. A closure as described in claim 10, wherein said ring member constructed as an arc encloses an angle of 100° to 330° about the actuating side, between the positions at which it is hinged to the cap.

12. A closure as described in claim 10, wherein said ring member constructed as an arc encloses an angle of 120° to 180° about the actuating side between the positions at which it is hinged to the cap.

13. A closure as described in claim 1, wherein said slot means of the cap side wall consist of at least two slots, which are distributed in the same manner over the mutually opposite regions between the actuating side and the opposite side of the cap side wall, and wherein one tensioning member per slot is provided, which bridges said slot, is in the form of an arc, is elastically extensible when the slot is splayed, and is hinged to the cap side wall on either side of the slot which it bridges and at a short distance therefrom, whilst the lifting member provided on the actuating side is rigidly connected, and integral with, the cap side wall.

14. A closure as described in claim 13, wherein said two slots are provided, of which each is staggered, from the center of the actuating side, by an angle of about 60° towards the opposite side of the cap side wall.

15. A closure as described in claim 13, wherein said cap side wall has a non-circular lower circumferences, with the region of the inner annular bead located on the actuating side being at a shorter distance from the central axis of the cap than the lateral regions of the inner annular bead, which are interrupted by the slots.

16. A closure as described in claim 15, wherein the region of the inner annular bead located on the side opposite the actuating side is also at a shorter distance from the central axis of the cap than the intermediate regions of the inner annular bead, located between the actuating side and the opposite side.

17. A closure as described in claim 16, wherein said fixing means comprise a part constructed as a supporting member and firmly mountable on the bottle neck below the bottle mouth, on which supporting member the cap is hinged, in a manner which permits swivelling, on the side of the bridging member.

18. A closure as described in claim 13, wherein said cap possesses, on the inner wall of its upper face, a stopper part which, in the closing position, projects into the mouth of the bottle to act as a guide and seal.

19. A closure as described in claim 13, wherein said cap bears, on the inner wall of its upper face, as a sealing element, a stopper sleeve whereof, in the closing position, the lower end projects into the bottle mouth, whilst its cylindrical outer wall is chamfered towards the lower end, the chamfer being such that it projects out of the bottle mouth to beyond the frontal face of the bottle neck and, in the closing position, is pressed tangentially against the curved rim of the mouth of the bottle, as a result of which the pressure of the inner bead of the cap side wall against the underside of the orifice bead of the bottle is intenified and the stop regions of the ramps are angled slightly relative to the bottom surface of the recess of the ring member.

20. A closure as described in claim 19, wherein an annular space in the interior of the closure device around the said stopper sleeve is constantly in communication with the external air via the upper end of the slot.

21. A closure as described in claim 19, wherein said stopper sleeve is cup-shaped and is sealed from the inside of the bottle by a cross-wall located below the chamfer, whilst the recess surrounded by the stopper sleeve is open towards the top.

22. A closure as described in claim 19, wherein said cross-wall of the cup-shaped stopper sleeve is thickened and adjoins the end of the chamfer of the stopper sleeve by a flexible annular zone.

23. A closure as described in claim 19, wherein said stopper sleeve carries, on its outer wall, a plurality of annular ribs circumferential about the said stopper sleeve.

24. A closure as described in claim 23, wherein the height of the annular ribs is from 0.01 to 0.2 mm.

25. A closure as described in claim 18, wherein a central cavity is provided in the upper wall of the cap, within the periphery of the stopper part or the stopper sleeve, which cavity undergoes inward deformation when the cap side wall is splayed.

26. A closure as described in claim 25, wherein the wall of the cavity is thinner, at least towards its centre, then the upper wall of the cap surrounding the depression.

27. A closure as described in claim 18, wherein around the stopper part or the stopper sleeve there is provided, as an additional sealing element, a sealing collar which projects inwards from the upper inner wall of the closure device and which is elastically deformed in the closing position so that it rests sealingly on the frontal face of the bottle mouth.

28. A closure as described in claim 27, wherein a free passage at all times remains, between the stopper part and the free rim of the collar, to communicate with the inner space between the collar and the cap inner wall.

29. A closure as described in claim 27, wherein said sealing collar is of circular cross-section at its foot, which adjoins the inner wall of the cap, and is of elliptical cross-section at the free rim of the collar when the cap is in the open position, with the major axis of the ellipse extending from the non-actuating side to the opposite side wall of the cap and with the distance of the free rim of the collar from the foot of the collar being constant.

30. A closure as described in claim 27, wherein said sealing collar has a circular cross-section at its foot which adjoins the cap inner wall and at the free rim of the collar, and that axial cut-outs emanating from the free rim of the collar are provided so that the segments which are left between the cut-outs, of the collar wall which adjoins the free rim of the collar, are pushed together in the closing position and sealingly rest against the frontal face of the bottle mouth.

31. A closure as described in claim 27, wherein said sealing collar comprises a stiffened sealing ring and the collar wall which connects the said ring to the foot of the collar has a slightly deflectable foot wall zone adjoining the foot, a more flexible and more elastic bending zone which adjoins the foot wall zone, and a rigid neck zone, carrying the ring, the ring being thickened so that when it rests against the frontal face of the bottle mouth, a free space remains between this frontal face and the collar wall, which space is in communication with the external air through axial slots in the side wall of the cap.

* * * * *